United States Patent [19]

Busch et al.

[11] Patent Number: 4,845,755

[45] Date of Patent: Jul. 4, 1989

[54] REMOTE CONTROL HEARING AID

[75] Inventors: Dieter Busch, Forchheim; Friedrich Harless; Gerhard Krauss, both of Nuernberg, all of Fed. Rep. of Germany

[73] Assignee: Siemens Aktiengesellschaft, Berlin and Munich, Fed. Rep. of Germany

[21] Appl. No.: 768,973

[22] Filed: Aug. 23, 1985

[30] Foreign Application Priority Data

Aug. 28, 1984 [DE] Fed. Rep. of Germany ..... 3431584

[51] Int. Cl.[4] ..... H04R 25/00; H04R 25/04; G08C 1/08

[52] U.S. Cl. ..... 381/68; 340/825.68; 340/825.69; 381/68.2; 381/68.4

[58] Field of Search ..... 179/107 FD, 107 R, 2 A; 381/68, 68.4, 68.2; 340/825.68, 825.75; 379/102, 106

[56] References Cited

U.S. PATENT DOCUMENTS

| | | | |
|---|---|---|---|
| 4,121,198 | 10/1978 | Tsuboi et al. | 340/825.75 |
| 4,188,667 | 2/1980 | Graupe et al. | 381/68.4 |
| 4,198,620 | 4/1980 | Vogt et al. | 340/825.75 |
| 4,315,111 | 2/1982 | Thomas | 381/68.6 |
| 4,622,692 | 11/1986 | Cole | 381/68.4 |
| 4,628,907 | 12/1986 | Epley | 381/68.3 |

FOREIGN PATENT DOCUMENTS

| | | | |
|---|---|---|---|
| 1938381 | 2/1971 | Fed. Rep. of Germany . | |
| 2407726 | 2/1984 | Fed. Rep. of Germany . | |
| 1565701 | 4/1980 | United Kingdom | 381/68 |

*Primary Examiner*—Jin F. Ng
*Assistant Examiner*—Danita R. Byrd
*Attorney, Agent, or Firm*—Mark H. Jay

[57] ABSTRACT

A hearing aid with wireless remote control of at least one of its controllable functions. The microphone of the hearing aird is used as a receiving element for the control signals. Energy (such as ultrasound) which the hearing aid microphone can transform into electrical signals which are separated from the other signals in a remote control part and caused to act upon the control members is used as a control signal transmission medium. Equipping a hearing aid with a remote control according to the invention is suited in particular for miniature hearing aids and for hearing aids insertable into the ear canal.

6 Claims, 1 Drawing Sheet

REMOTE CONTROL HEARING AID

BACKGROUND OF THE INVENTION

The invention relates to hearing aids. Instruments of this kind are known from DE-OS 19 38 381, for example.

Hearing aids should be as small as possible so that they can be worn inconspicuously. Miniature instruments which can be worn in the ear canal have proved especially beneficial. The volume should be adjustable in these instruments. This requires controls operable from the outside so that the instrument can be adjusted when in operation. In small instruments, however, little area is available for the accommodation of operating elements accessible also when the instrument is being worn.

Accordingly, in the above mentioned DE-OS 19 38 381, the components are distributed between two housings. The first housing contains a transmitter wirelessly connected to the second housing, which contains the components of a hearing aid and a receiver tuned to the transmitter. It is unnecessary to design the instrument so that controls were accessible from the outside. Rather, the controls are mounted on a housing held in a user's pocket. In this way, controls need not comply with strict space requirements, and the adjustments can be made by sight. But wireless transmission requires antennas which require space, available only to a very limited extent, especially in minuature hearing aids.

One object of the invention is to provide remote controllability which can be accommodated very compactly in the actual hearing aid.

SUMMARY OF THE INVENTION

In accordance with the invention, the microphone of the hearing aid is co-utilized as a receiving element for the control signals, and the energy used for the transmission of the control signals is transformed by the hearing aid microphone into electrical signals which can be separated from the other signals and can be caused to act upon the control element. This is possible because minature microphones as used in small hearing aids also respond to sound imperceptible to the human ear. Usually, microphones used in hearing aids still transmit with sufficient sensitivity in the ultrasonic range up to 25 kHz. In addition, some types have a utilizable resonance between 45 kHz and 50 kHz in the ultrasonic range. It is then possible, by means of an ultrasonic transmitter working in this frequency range, to transmit control signals to the hearing aid and make them effective there. No additional receiving antenna for the control signals is required in the hearing aid.

Microphones suited for the simultaneous receiption of audio signals and control signals in the present invention have a transmission range up to approximately 25 kHz or having a distinct resonance at even higher frequencies such as between 45 kHz and 50 kHz. This resonance comes about because in some of the usual miniature microphones, the dimensions of their housings correspond to wavelengths in the ultrasonic range.

A remote control receiver which can be installed in a miniature receiver must be designed so that it leaves room for the hearing aid components even in the smallest housing. The hearing aid amplifier as well as the remote control circuit may advantageously be IC components, so that the required components can all fit in one hearing aid housing. Because there is usually only one miniature battery in the hearing aid housing, it should preferably be possible to operate the device with voltages of about 1.0 to 1.5 V. The current consumption of the control circuit should advantageously not exceed 10% of the current for the hearing aid output stage so that an adequate operating life can still be obtained with one battery charge. This condition can be satisfied if current saving low-voltage CMOS integrated circuits are used.

BRIEF DESCRIPTION OF THE DRAWINGS

Exemplary and non-limiting preferred embodiments of the invention are shown in the drawing, in which.

DETAILED DESCRIPTION OF PREFERRED EMBODIMENTS

Figure 1:
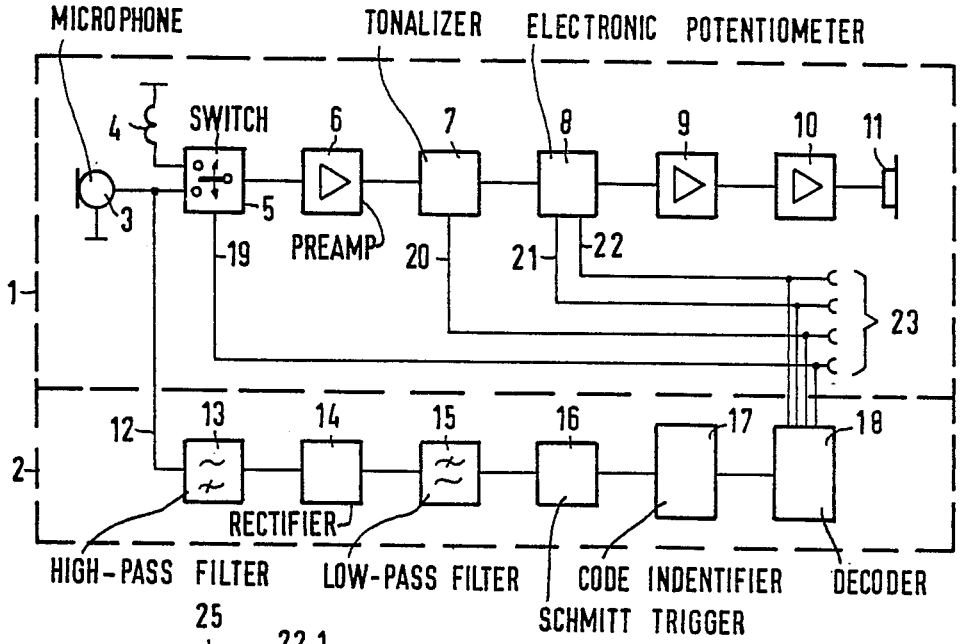
FIG. 1 is a block diagram of a preferred embodiment of the invention.

FIG. 1 shows a hearing aid comprising a hearing aid part 1 and a remote control part 2. The hearing aid part 1 includes input transducers, i.e. a microphone 3 and an induction pick-up coil 4, both alternately connectable to the remaining circuitry via a double-throw switch 5. The signal picked up in the microphone 3 or coil 4 then arrives, via a controllable preamplifier 6 and a tonalizer 7, at an electronic potentiometer 8 whence it reaches a driver amplifier 9 and then an output stage amplifier 10. Finally, the amplified signal is retransformed into sound in an output transmitter 11, i.e. an earpiece, which sound is fed to the ear of the user.

Part 2 of the instrument has a connection line 12 to the microphone 3. Thus, signals go from the microphone directly to a high-pass filter 13 which separates the actual control signals from the audio signals, thence to a rectifier 14 and subsequently to a low-pass filter 15. The rectifier 14 and low-pass filter 15 act as a demodulator for amplitude-modulated signals in the usual sense, its function being that the signals are present in a form suited for digital processing. The signal coming from the low-pass filter 15 then goes to a Schmitt trigger 16 which detects whether the signal is big enough for further processing. Both the interference suppression point and the range of the transmission channel are fixed in this Schmitt trigger 16. Subsequently, the signal is fed to a shift register 17 for code identification, whence it reaches a decoder 18; there, the signal is decoded so that it gets to the switch 5 or to the tonalizer 7 or to an electronic potentiometer 8 via lines 19, 20, and 21 and 22, respectively. Additionally, the lines 19–22 have terminals 23 to which a manually operable control unit 25 shown in FIG. 2 can be plugged.

Figure 2:
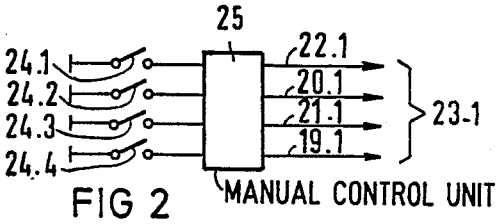
FIG. 2 shows a manual operating part attachable to the preferred embodiment.

The manual control unit shown in FIG. 2 has operating keys 24.1 through 24.4 which allow variation of the debouncing circuits and pulse formers contained in the key control unit 25 in such a manner that, through the plugs 19.1–22.1 which can be plugged into the sockets of lines 19–22, appropriate signals get to the switch 5, the tonalizer 7 or the electronic potentiometer 8 to result in an adjustment of the hearing aid in the desired sense in that listening coil 4 and microphone 3 are switched at switch 5 and the desired change in the audio frequency response takes place at the tonalizer 7.

The electronic potentiometer 8 increases the volume when control pulses arrive via the line 21. The amplification can be reduced by directius control signals through the line 22.

Figure 3:
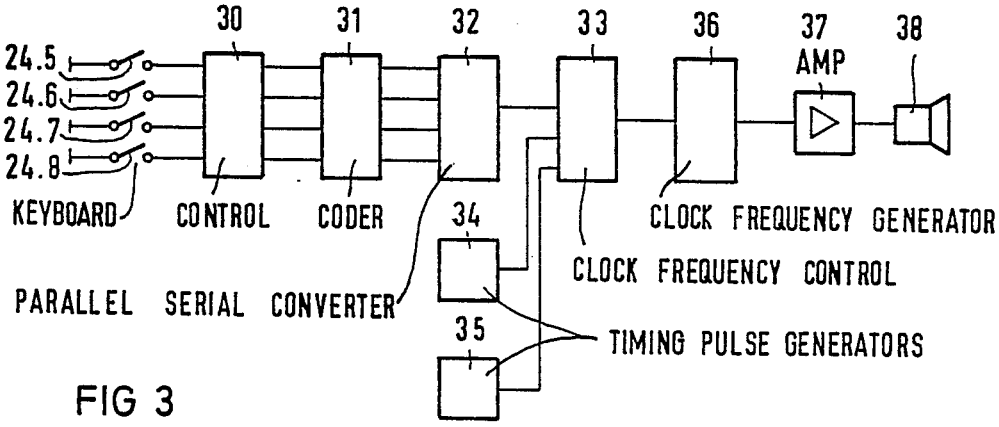
FIG. 3 shows a transmitting device for the remote control of the preferred embodiment.

According to FIG. 3, a keyboard 24.5 through 24.8 is provided for remote control, as in FIG. 2. It, too, consists of 4 switches. As in FIG. 2, these switches are connected to a key control 30 in which signals are generated by actuating the keys 24.5 through 24.8 which are similar to those generated by the actuation of the keys 24.1 through 24.4 in FIG. 2. These signals are coded in a subsequent coder 31 so that an unequivocal digital code word is coordinated with each command of the keys 24.5 through 24.8. The control signal so processed then goes to a parallel-serial converter 32 where it is edited for serial output to the transmission line. This signal is subsequently fed for modulation to a clock frequency control 33 where the signals of a timing pulse generator 34 determine the duration of the logical 0 signals and the signals of a timing pulse generator 35 determine the duration of logical 1 signals. This processes the signal so that when it then arrives at a clock frequency generator 36 it is modulated there with the clock frequency in the ultrasonic range. Finally, an amplifier 37 further intensifies the signals so that they can be emitted through a loudspeaker 38 to act upon the microphone 3.

The switch 5 can be switched via the remote control per FIG. 3 so that the associated pulse sequence is triggered by depressing the key 24.5 in the remote control. Thus, a signal is obtained through the loudspeaker 38 and received by the microphone 3. The control signal is separated from the audio signal by the selection elements 13 through 16 of the remote control part of the hearing aid. It then reaches the code identifier 17 where it is determined whether interference pulses were received also. In the decoder 18 the associated pulse sequence mentioned is then re-recognized so that a signal is applied to the terminal 19. It then throws the switch 5 so that the microphone 3 is connected. Switching to the induction pickup coil 4 or activating it takes place when the next similar pulse sequence recurs.

Similarly, the tonalizer 7 is activated through the terminal 20 by the actuation of the key 24.6. To do so, another associated pulse sequence is used.

The volume is varied in the electronic potentiometer 8 via the terminals 21 and 22 by actuating the keys 24.7 and 24.8. This generates the corresponding control signals in that respectively coordinated pulse sequences are repeated, i.e. a generator in the key control unit produces pulses which generate the associated pulse sequences in the coder 31 and edit them for emission in the parallel-serial converter 32. The clock frequency control 33 and the clock frequency generator 36 work analogously, as described in the last paragraph. Thus, after amplification in amplifier 37, the loudspeaker 38 can emit a signal which results in the microphone in a signal which, after passing the elements 13 through 16 in the code identifier 17, is checked for mistransmission. Then, through the decoder 18, the volume of the hearing aid is increased on the one hand by actuating the key 24.7 and decreased, on the other hand, by actuating the key 24.8.

Those skilled in the art will understand that changes can be made in the preferred embodiments here described, and that these embodiments can be used for other purposes. Such changes and uses are within the scope of the invention, which is limited only by the claims which follow.

What is claimed is:

1. A remote controlled hearing aid comprising:

a single microphone responsive to audible information and to sound control signals and converting said information and sound control signals into a corresponding electrical signal;

means for separating, from said corresponding electrical signal, electrical control signals derived from said sound control signals;

a tonalizer;

means for adjusting hearing aid elements, including said tonalizer, dependent on said electrical control signals; and a control circuit branch, said branch being connected to the microphone, and containing a high-pass filter which passes only electrical ultrasound control signals wherein the control circuit branch further comprises a rectifier, a low-pass filter, a Schmitt trigger, a code identifier and a decoder connected in series with the high-pass filter, and wherein the control circuit branch is connected to said adjusting means.

2. The hearing aid of claim 1, further comprising a hearing aid branch and a switch which is remote controlled by said decoder dependent on the electrical control signals, and which is connected to disconnect the hearing aid branch from the microphone and to connect said hearing aid branch to an induction pick-up coil.

3. The hearing aid of claim 1, further comprising a hearing aid branch which comprises an electronic potentiometer for volume control, said electronic potentiometer being controlled by said decoder dependent on the electrical control signals.

4. The device for remote control of a remote controlled hearing aid of the type which includes a single microphone responsive to audible information and to sound control signals and converting said information and sound control signals into a corresponding electrical signal, means for separating, from said corresponding electrical signal, electrical control signals derived from said sound control signals, and means for adjusting hearing aid elements dependent on the electrical control signals, said device comprising a keyboard having keys and comprising means for generating and transmitting sound control signals to said microphone of said hearing aid dependent on the actuating of the keys of said keyboard.

5. A device according to claim 4, wherein said means for generating and transmitting sound control signals comprise a key control connected with the keys of said keyboard, and in series, connected with the key control, a coder, a parallel-serial converter, a clock frequency control, a clock frequency generator, an amplifier and a loudspeaker.

6. In combination: a remote controlled hearing aid, which comprises a single microphone responsive to audible information and sound control signals and converting said information and sound control signals into a corresponding electrical signal, means for separating, from said corresponding electrical signal, electrical control signals derived from said sound control signals; and means for adjusting hearing aid elements dependent on the electrical control signals; and a device including a keyboard having at least one key and means for generating and transmitting sound control signals to said microphone of said hearing aid dependent on actuation of said at least one key.

* * * * *